109-49.5 SR
8/2/83 XR 4,395,861

United States Patent [19]
Fipke et al.

[11] 4,395,861
[45] Aug. 2, 1983

[54] SECURITY GRID FOR LIGHTING SHAFTS AND THE LIKE

[76] Inventors: Boris Fipke, Kollwitz-strasse 15, D-8000 Munchen 45; Franz Oswald, Dachauer Strasse 419, D-8000 Munchen 50, both of Fed. Rep. of Germany

[21] Appl. No.: 175,589

[22] Filed: Aug. 5, 1980

[30] Foreign Application Priority Data

Aug. 8, 1979 [DE] Fed. Rep. of Germany ..... 2932205

[51] Int. Cl.³ ..... E04F 17/06; E06B 9/01; E06B 5/10

[52] U.S. Cl. ..... 52/727; 52/106; 52/656; 109/49.5; 49/50

[58] Field of Search ..... 109/2, 23 R, 49.5, 1, 109/11; 52/106, 727, 656; 49/50; 138/140; 182/204

[56] References Cited

U.S. PATENT DOCUMENTS

| | | | |
|---|---|---|---|
| 207,476 | 8/1878 | Baker | 52/106 |
| 679,028 | 7/1901 | Larmore | 52/727 |
| 1,803,272 | 6/1929 | Greenley | 52/106 |
| 2,103,130 | 12/1937 | Windle | 52/106 |
| 2,237,564 | 4/1941 | Keyes | 49/50 |
| 2,503,537 | 4/1950 | Youngblood | 52/727 |
| 3,394,774 | 7/1968 | Lanier | 182/204 |

FOREIGN PATENT DOCUMENTS

| | | | |
|---|---|---|---|
| 1113555 | 9/1961 | Fed. Rep. of Germany | 52/106 |
| 2624149 | 8/1977 | Fed. Rep. of Germany . | |

*Primary Examiner*—Reinaldo P. Machado
*Attorney, Agent, or Firm*—Armstrong, Nikaido, Marmelstein & Kubovcik

[57] ABSTRACT

A security grid for an opening is provided which includes at least two support members fixed on opposite side walls of the opening. Each support member is a hollow rectangular solid. A plurality of tube members extend between and are received in the support members with each of the tube members comprising a hollow tube and a core member inserted in the hollow tube. The core has a length which is greater than the distance between opposite inner walls of the support members. Each of the support members includes holes in the side walls thereof for receiving the tube members therein. Screw-plugs are provided for fixing the support members to the side walls of the opening and the support members include stoppers for closing the ends of the hollow rectangular solid. Further, the hollow rectangular solid includes at least one opening in the top thereof and concrete is poured into the interior of the hollow rectangular solid through the hole, and a reinforcing rod may be set in the concrete. In an alternative embodiment, the hole in the support member extends to the bottom of the side of the support member and extends over at least a portion of the bottom thereof. The support member further includes a slide supported in the support member and slidable in the longitudinal direction thereof. The slide includes openings which are in alignment with the hole to permit the insertion of the tube member into the hole. The slide is slidable to misalign the openings with the hole to prevent the removal of the tube member from the hole.

12 Claims, 9 Drawing Figures

SECURITY GRID FOR LIGHTING SHAFTS AND THE LIKE

BACKGROUND OF THE INVENTION

1. Field of the Invention

This invention is directed to a grid for covering an opening and more particularly to a grid for covering an opening in which hollow tubes having cores therein are received in supports on opposite sides of the opening such that the ends of the cores are positioned within the support thereby preventing the cutting of the tube.

2. Description of the Prior Art

For a great number of years, grids for windows or other openings have been protected against willful destruction by sawing, by designing the grid bars as tubes with loose iron rods in them so that, on making any attempt at sawing, the rods are turned and not readily cut. Furthermore, such forms of grids have been used for protection of lighting shafts against thieves making an attempt at breaking into a building. In this case, the grid has under its normal grid bars, stretching across the lighting shaft, two U-girders which are fixed to the side walls of the shaft by screw-plugs let into the wall. Four-cornered iron blocks are welded to the U-girders for taking up steel pipes, flattened at their ends, and having within them round steel rods, cut to the desired length (see German Offenlegungsschrift specification No. 2,624,149). Such round steel rods placed loosely within the steel tubes necessarily have to be shorter than the steel tubes themselves in this design so that, in fact, the steel tubes may be cut through next to the iron blocks by a thief.

SUMMARY OF THE INVENTION

It is the primary object of the present invention to provide a security or thief-proof grid for lighting shafts and the like which prevents any sawing through of the tubes next to the supports.

In the present invention, this object is effected because the supports are designed as box-griders with openings for taking up the ends of the tubes.

In the grid of the present invention, core rods within tubes may be readily made of the same length as the tubes and the ends of the tubes and of the cores are protected within a box-girder of the support.

In one embodiment of the invention, the openings for receiving the ends of the tubes in the girders is made round, and there is some play between the inner edges of the openings and the tubes within them for making it simpler for the grid structure to be placed in position. The box-girders themselves may be closed at one or both ends by lids or stopper-like end pieces, and in cases where no emergency opening from inside in the case of danger is necessary, the box-girders may be filled with concrete by casting, for example, through casting openings specially placed on the top parts of the box-girders and, furthermore, the assembly openings may be shut off by stoppers.

For reinforcing the concrete, it is, for example, possible to have a round steel rod placed loosely inside the box-girder or loosely slipped into the end pieces.

In those cases, when a grid, designed for stopping thieves breaking into the building, has to be able to be opened in cases of emergency, as for example, when the grid is used over the lighting shaft of a hobbyroom, the invention may be modified, making it readily possible for the grid structure to be opened from the inside.

BRIEF DESCRIPTION OF THE DRAWINGS

In the figures like reference numbers are used for generally like parts.

DETAILED DESCRIPTION OF THE PREFERRED EMBODIMENTS

Figure 1:
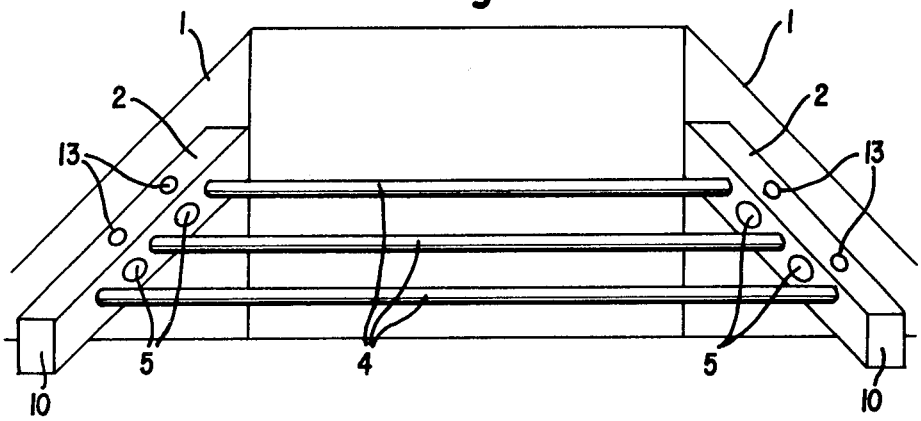
FIG. 1 is a diagrammatic view of a grid of the present invention for a lighting shaft.
Figure 2:
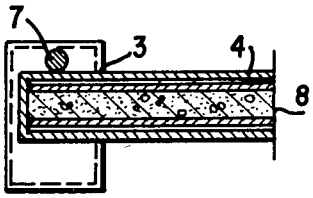
FIG. 2 is a view of the ends of the pipes placed within the box-girders, in cross-section and on a greater scale.
Figure 4:
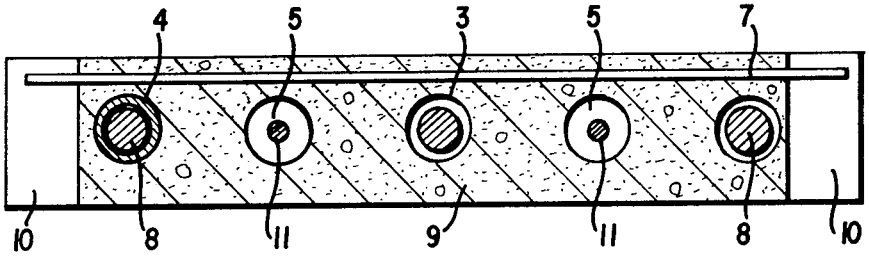
FIG. 4 is a view of a support from the inside.
Figure 3:
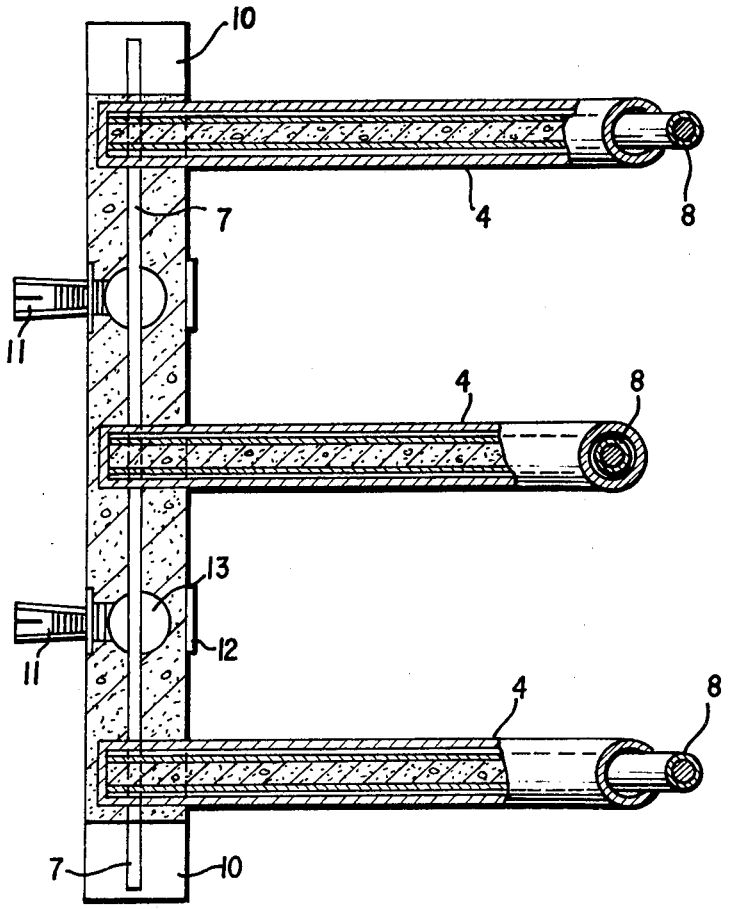
FIG. 3 is a horizontal section through one side of the grid of the present invention.

In the embodiment of FIGS. 1 to 4 on each side wall 1 of a lighting shaft, a support 2, in the form of a hollow, rectangular solid, box-girder, is fixed with the help of dowels or screw-plugs 11. The supports 2 are formed from tubes of rectangular cross-section, of steel or aluminum, the ends of the tubes 2 are closed by end pieces 10 of rectangular tube of steel or aluminum. In the top third of the end pieces 10 there is, in each case, a hole for receiving a round steel rod 7. Openings 3 are formed in the inner sides of the rectangular tubes 2. The openings 3 receive outer tubes 4 with cores or rods 8 placed loosely within them. As will be seen more specially from FIG. 2, the outer tubes 4 are closed at the ends and the cores 8 have the same length as the tubes 4. Cores 8 may be made of round steel rod or a hollow pipe filled with concrete for stopping them from being sawed through, such sawing furthermore can be stopped by the fact that the cores are loose and readily turned by the saw.

The inner side walls of the rectangular tubes 2 have openings 5 for screw-plugs 11, such holes 5 being closed, after fixing the grid in position, by plastic stoppers 12. The tubes 4 are best galvanized. In the embodiment shown in FIGS. 1 to 4 there are, furthermore, openings 13 on the top sides of the rectangular tubes 2 for placing concrete 9 in the interior of the support 2.

The fixing in position of such a grid is very simple and easy. Firstly, one rectangular tube 2 is fixed to one inner side 1 of the lighting shaft and then the cores 8 are slipped into the tubes 4, which are then closed with stoppers or plugs and then placed into the openings 3 of the fixed-in-position rectangular pipe 2. Nextly, the second rectangular tube 2 is slipped over the other ends of the tubes 4 and fixed to the opposite side face 1 of the lighting shaft, in the same way as the first rectangular tube using screw-plugs 11 set into the wall. After being screwed up tight in position, the two rectangular tubes 2 are filled up by pouring concrete into them.

Figure 5:
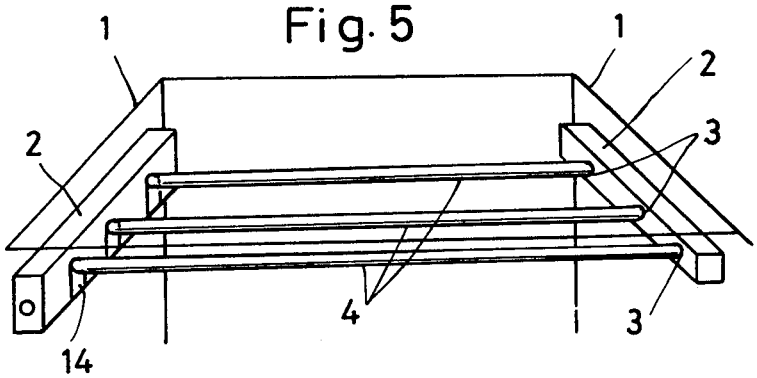
FIG. 5 is a diagrammatic view of another embodiment of the invention.
Figure 7:
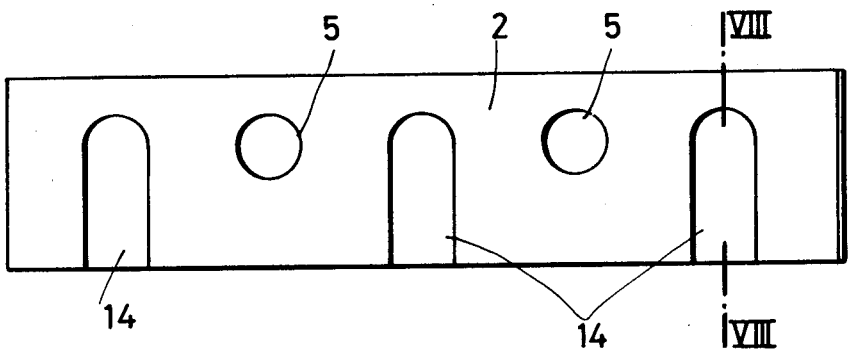
FIG. 7 is the same inside-view without, however, the slide locking system to be seen in FIG. 6.
Figure 8:
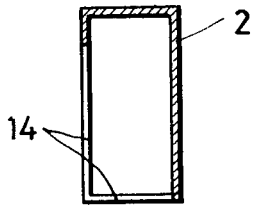
FIG. 8 is a section on the line VIII—VIII of FIG. 7.
Figure 6:
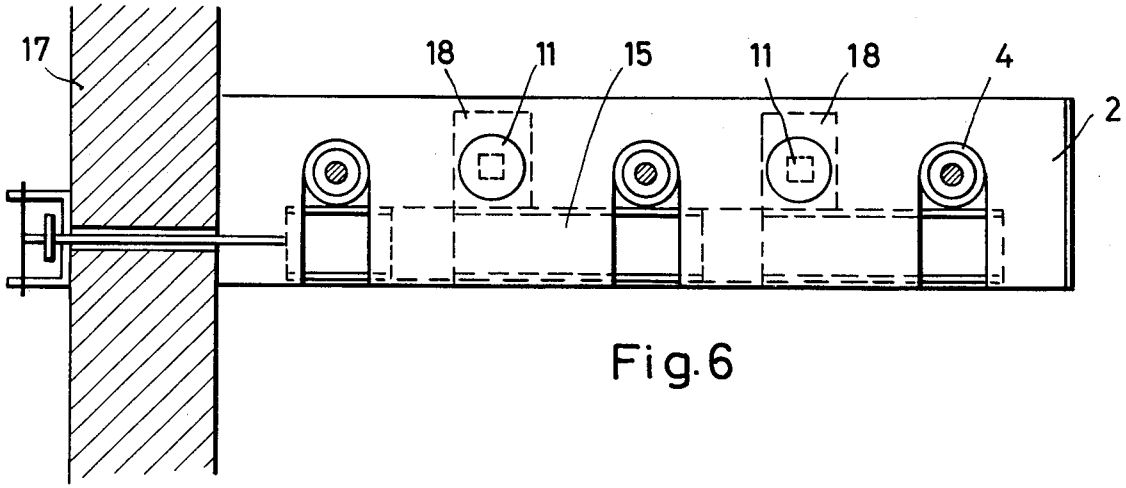
FIG. 6 is a view, as seen from the inside, of a support as used in the embodiment of FIG. 5.
Figure 9:
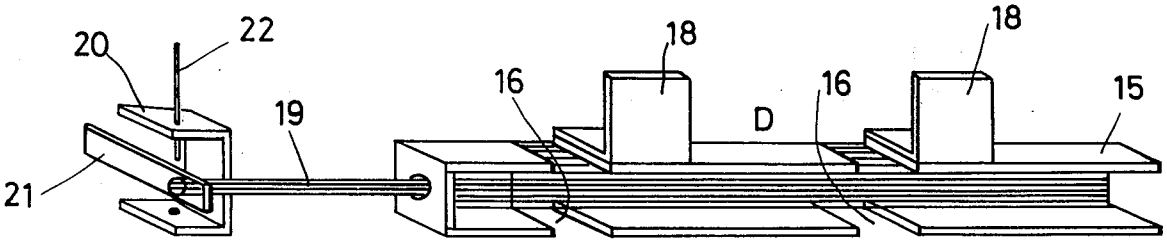
FIG. 9 is a view of a locking system for the embodiment of FIGS. 5 to 8.

In the embodiment of FIGS. 5 to 9, on the left hand side of FIG. 5, the openings 14 of rectangular tube 2 for receiving the tubes 4 are designed to open downwards. The holes 5 for the fixing screw-plugs are the same as in the first embodiment. For supporting the tubes 4 in the locked position, a slide 15 is placed within the left hand tube 2 of rectangular cross-section so that it may be moved along its length. Slide 15 has openings 16 which, in the locked position, are out of alignment with the openings 14 in the rectangular tube 2, but may be moved into alignment with the openings 14 when the slide is moved to the left in the length-direction. In this unlocked position downward motion of the tubes 4 at their left hand ends is possible under their own weight so that the grid may be readily opened in an emergency for persons to get out of the building quickly.

Angle-wings 18 may be put on slide 15 for shutting off the openings 5 in front of the screw-plugs 11, so that such plugs may not be reached from the outside, when the slide 15 is in the locked position.

Furthermore, the slide 15 has a driving rod 19 which passes through the wall 17 for changing the position of rod 19. On the inner side of the building wall 17 there is a support angle piece 20 for rod 19 and a handle 21. The rod 19 is fixed in position by a locking pin 22.

In general, it will only be necessary to have this unlocking system for the security grid on one support, the other support being designed as in FIGS. 1 to 4, although in the embodiment of FIGS. 5 to 9, the rectangular tubes 2 can not be filled cast concrete.

Furthermore, no special fixing or assembly openings are needed in the side wall, not resting against the face of the building, of the rectangular pipes 2 for the screw-plugs 11. Access to the screw-plugs 11 may be had through the openings for putting in the tubes 4. When the grid has all its parts assembled, it is not possible for pieces to be taken out of position. Generally, the grid, more specially in the form of FIGS. 1 to 4 may be designed for spanning greater distances, as for example, distances greater than 1.30 m and may be so designed that between the end supports an intermediate support is present with through-openings for the pipes 4 and the cores 8 and the two ends of the grid are fixed in concrete in the front and back walls. As a further useful modification of the invention, this intermediate support may be designed as a box-girder, filled with concrete as well. Such an intermediate support makes it hard or impossible for the tubes of the grid to be bent by force.

The present invention may be embodied in other specific forms without departing from the spirit or essential characteristics thereof. The presently disclosed embodiments are, therefore, to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A security grid assembled on site for covering an opening, said grid comprising:

(a) at least two support means fixed on opposite side walls of said opening, each said support means being a hollow box girder having a rectangular cross-section; and (b) a plurality of tube means extending between and received in said support means, each said tube means comprising a hollow tube and a freely rotatable core member inserted therein, said core member having a length greater than the distance between opposite inner walls of said support means, wherein the length of said core member is less than or equal to the length of said hollow tube;

(c) wherein, each said support means includes first hole means in said inner wall thereof for receiving said tube means therein.

2. A security grid as set forth in claim 1 wherein said support means includes second hole means, said security grid including screw-plug means for fixing said support means to the side walls of said openings, wherein said screw-plug means are positioned within said support means such that access thereto is through said second hole means.

3. A security grid as set forth in claim 1, wherein said tube means includes means for closing the open ends of said hollow tube.

4. A security grid as set forth in any one of claims 1, 2 or 5, wherein said support means includes means for closing the ends of said hollow box girder.

5. A security grid as set forth in any one of claims 1, 2 or 3, wherein said first hole means is round.

6. A security grid as set forth in any one of claims 1, 2 or 3, wherein said hollow box girder includes at least one opening in the top thereof.

7. A security grid as set forth in claim 6 including concrete in the hollow interior of said hollow box girder.

8. A security grid as set forth in claim 7 including a reinforcing rod set in said concrete.

9. A security grid as set forth in any one of claims 1, 2 or 3, wherein said first hole means extends to the bottom of the side of the support means and extends over at least a portion of the bottom thereof, and wherein said support means includes slide means supported in said support means and slidable in the longitudinal direction thereof, said slide means including openings therein for alignment with said first hole means to permit the insertion of said tube means into said first means, said slide means being slidable to misalign the openings therein and said first hole means to prevent removal of said tube means from said hole means.

10. A security grid as set forth in claim 9, wherein said slide means includes end means extending through a wall of said opening, said end means being movable to cause the movement of said slide means.

11. A security grid as set forth in claim 9, wherein said slide means includes flange means for covering said screwplug thereby preventing access thereto.

12. A security grid as set forth in claim 1, wherein said hollow box girder includes a rod means extending substantially the longitudinal distance of said hollow box girder.

* * * * *